United States Patent [19]

Shimoda et al.

[11] Patent Number: 4,867,033

[45] Date of Patent: Sep. 19, 1989

[54] IDIOPHONE HAVING A RESONANT CHAMBER

[75] Inventors: Isao Shimoda; Shigemitsu Fujioka, both of Hamamatsu, Japan

[73] Assignee: Yamaha Corporation, Japan

[21] Appl. No.: 120,858

[22] Filed: Nov. 16, 1987

[30] Foreign Application Priority Data

Nov. 17, 1986 [JP] Japan ..... 61-273231

[51] Int. Cl.[4] ..... G10D 13/08

[52] U.S. Cl. ..... 84/410; 446/419

[58] Field of Search ..... 84/402–405, 84/410; 446/419, 221, 418

[56] References Cited

U.S. PATENT DOCUMENTS

| | | | |
|---|---|---|---|
| 1,173,784 | 2/1916 | Deagen | 84/403 |
| 2,787,029 | 4/1957 | Musser | 84/410 X |
| 3,610,085 | 10/1971 | Wilson et al. | 84/402 |

*Primary Examiner*—L. T. Hix
*Assistant Examiner*—Brian W. Brown
*Attorney, Agent, or Firm*—Lerner, David, Littenberg, Krumholz & Mentlik

[57] ABSTRACT

A handle for an idiophone such as a claves has a tubular grip internally provided with a resonant chamber opening towards the main body of the musical instrument for generation of high tonal pitch sounds with long decay time.

12 Claims, 2 Drawing Sheets

Fig. 1
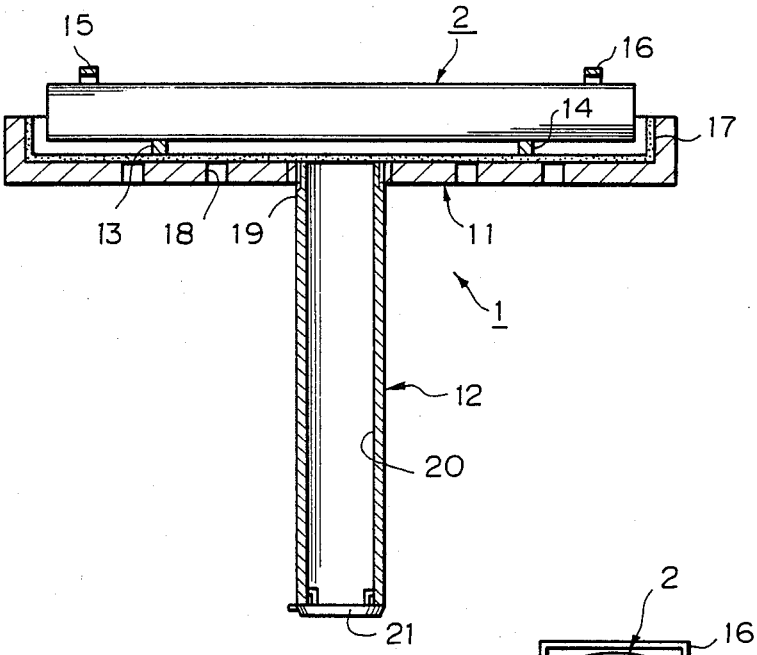
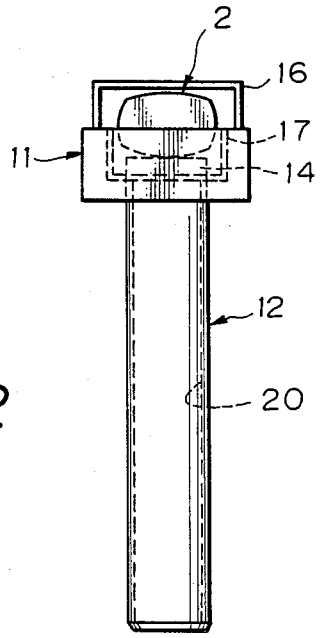
Fig. 2

IDIOPHONE HAVING A RESONANT CHAMBER

BACKGROUND OF THE INVENTION

The present invention relates to an improved idiophone and more particularly relates to improvement in the function of the handle for a idiophone; such as a clave, a handbell or a wood block.

The handle of a conventional idiophone is only used for holding the instrument and is directly fixed to the body of the musical instrument. Such handles have a length and a thickness suited for manual holding. In the case of an idiophone without such a handle, for example a clave, the main body of the instrument is directly held by the player's hand.

Generally, conventional idiophone handles do not play any role in enhancing the acoustic characteristics of the instrument. In the case of such a musical instrument without a handle, a high level of skill is required when holding the main body for the development of preferable acoustic characteristics.

SUMMARY OF THE INVENTION

It is the object of the present invention to provide a handle for the idiophone with an additional function to enhancing the acoustic characteristics of the instrument.

In accordance with the basic concept of the present invention, an idiophone includes a handle which in turn includes a resonant chamber having an opening directed towards the main body of the musical instrument.

BRIEF DESCRIPTION OF THE DRAWINGS

FIG. 1 is a front view, partly in section, of one embodiment of the handle in accordance with the present invention, FIG. 2 is its side view.

Figure 3:
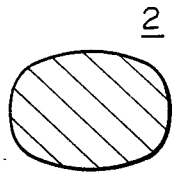
FIGS. 3 to 5 are sectional views of various claves.

One embodiment of the idiophone handle in accordance with the present invention is shown in FIGS. 1 to 3, which is applied to a clave. Clave 2 is mounted to a roughly T-shaped handle 1. The handle 1 includes an elongated support box 22 extending in parallel to the claves 2 and a grip 12 connected at a right angle to the middle of the support box 11 via a thread 19. The support box 11 is open upwards and the grip 12 is fixed to its bottom wall. The clave 3 is accommodated in the support box 11 via a pair of seats 13 and 14 made of felt. The seats 13 and 14 are preferably located at positions along the length of the clave 2 where nodes of vibration exist when the clave is struck. The positions of the seats 13 and 14 are preferably adjustable. A recess may be formed in the top face of each seat in order to meet the configuration of the claves. At positions not hindering smooth performance, the support box 11 is further provided with stoppers 15 and 16 in an easily detachable fashion in order to prevent accidental detachment of the clave 2.

A liner 17 is bonded to the inner wall of the support box 11 and a number of small sound holes 18 are formed through the bottom wall of the support box 11. The liner 17 is made of foam resin such as polyurethane foam. The liner 17 comes into intermittent content with the clave 2 when the latter vibrates and/or absorbs sounds passing through the sound holes 18 so that the resultant vibration of the clave 2 should be close to that generated when the clave is held directly by hand. In order to provide better acoustic characteristics, the size and position of the liner 17 is carefully adjusted in consideration of the designs of the sound holes 18 and the resonant chamber 20 described hereinafter. The liner 17 may cover either the entire inner wall of the support box 11 or only the side walls of the support box 11. Alternatively, different walls of the support box 11 may be covered by liners of different kinds.

Figure 6:
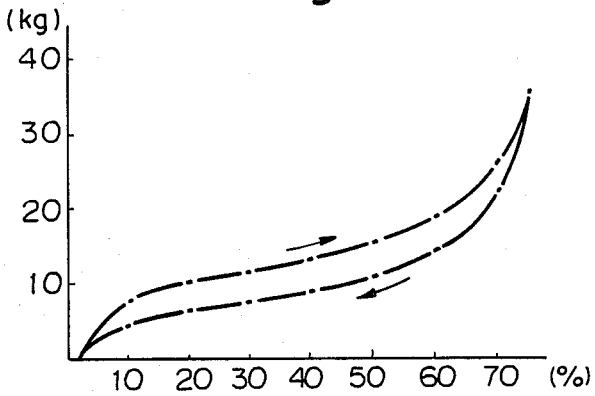
FIGS. 6 to 8 are graphs for showing various characteristics of a liner used for the handle in accordance with the present invention.
Figure 7:
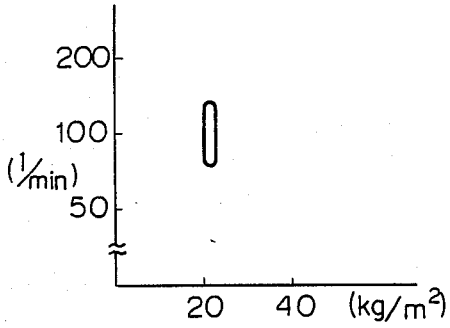
Figure 8:
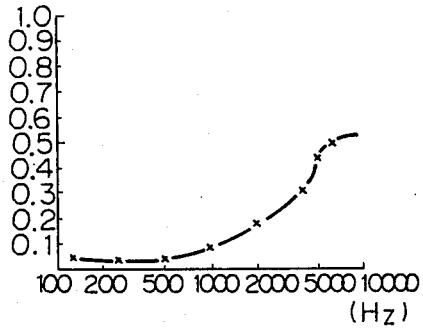

Various characteristics of a polyurethane foam liner are shown in FIGS. 6 to 8. In FIG. 6, flexion in % of the liner is taken on the abscissa and the weight in kg of the liner is taken on the ordinate. The size of the test sample is 50×300×300 mm, the diameter of the compression plate is 200 mm and the compression rate is 50 mm/min. In FIG. 7, density in kg/m$^2$ of the liner is taken on the abscissa and air permeability in l/min is taken on the ordinate. The liner thickness is 25 mm and the test is conducted in accordance with ASTM D1564-71. In FIG. 8, sound frequency in Hz is taken on the abscissa and percent sonic absorption of 90° angle of incident is taken on the ordinate. A liner of 10 mm thickness is tightly attached to a rigid wall.

The grip 12 takes the form of an elongated pipe which internally defines a resonant chamber 20 of a prescribed dimension. This resonant chamber 20 is closed at one end by a cap 21 and provided at the other end with an opening directed towards the clave 2 accommodated in the support box 11.

The dimension of the resonant chamber 20 is designed in view of the type of the clave 2. Since the grip 12 is detachably coupled to the support box 11 via the thread 19, the dimension of the resonant chamber 20 can be freely changed by using grips of different types. In addition, subtle adjustment in length of the resonant chamber 20 can be achieved by fine adjustment in thread engagement even using a same grip 12. As a substitute for such a thread engagement, however, a grip 12 may be secured to the support box 11 by assistance of a set screw.

Figure 4:
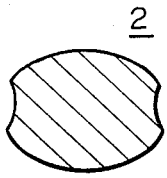
Figure 5:
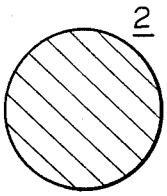

The handle 1 of the present invention is well usable for claves of various cross-sectional profiles such as shown in FIGS. 3 to 5. It is also applicable to any type of idiophones other than a clave.

Since the opening of the resonant chamber 20 in the grip 12 is directed towards the claves 2 in the support box 11, high tonal pitch is obtained at generation of sounds by the musical instrument. Use of the holder in accordance with the present invention assures an elongated decay time of sounds generated by the musical instrument. Presence of the resonant chamber in the grip results in a compact entire construction of the handle.

We claim:

1. An improved handle for an idiophone having a main body comprising:

support means for supporting the main body of said idiophone at a predetermined location, said support means having at least one inner wall, said at least one inner wall of said support means being covered with a liner whereby sound produced by said idiophone can be absorbed thereby and a grip coupled to said support means, said grip having an internal resonant chamber and an opening communicating with said internal resonant chamber directed to said predetermined location.

2. An improved handle as claimed in claim 1 including detachment means for detachably coupling said grip to said support means.

3. An improved handle as claimed in claim 2 wherein said detachment means comprises corresponding thread means on said grip and said support means.

4. An improved handle as claimed in claim 1 wherein said support means includes at least one sound hole extending therethrough.

5. An improved handle as claimed in claim 1 wherein said liner comprises a resin layer.

6. An improved handle as claimed in claim 1 wherein said support means includes at least two inner walls and wherein said at least two inner walls of said support means are each covered with a liner.

7. An improved handle as claimed in claim 5 wherein said resin layer comprises a foam resin.

8. An improved handle as claimed in claim 6 wherein each of said liners covering each of said at least two inner walls comprises a different liner.

9. An improved handle as claimed in claim 1 said support means including seat means for seating said main body at said predetermined location spaced from said at least one inner wall.

10. An improved handle as claimed in claim 1 including stop means extending from said support means and surrounding said predetermined location so as to maintain said idiophone in said predetermined location.

11. An improved handle as claimed in claim 10 wherein sait stop means are substantially U-shaped in configuration.

12. An improved handle as claimed in claim 9 wherein said seat means includes a first surface conforming in shape to said support means and a second surface conforming in shape to said main body of said idiophone.

* * * * *